US011253037B2

(12) United States Patent
Bomer

(10) Patent No.: US 11,253,037 B2
(45) Date of Patent: Feb. 22, 2022

(54) CORNER BUMPER

(71) Applicant: NEXUS TECHNOLOGIES, INC., Fletcher, NC (US)

(72) Inventor: Benjamin W. Bomer, Swannanoa, NC (US)

(73) Assignee: Nexus Technologies, Inc., Fletcher, NC (US)

( * ) Notice: Subject to any disclaimer, the term of this patent is extended or adjusted under 35 U.S.C. 154(b) by 390 days.

(21) Appl. No.: 16/211,944

(22) Filed: Dec. 6, 2018

(65) Prior Publication Data

US 2019/0174895 A1 Jun. 13, 2019

Related U.S. Application Data

(60) Provisional application No. 62/595,639, filed on Dec. 7, 2017.

(51) Int. Cl.

| | |
|---|---|
| ***A45C 13/36*** | (2006.01) |
| ***A45C 11/00*** | (2006.01) |
| ***B65D 81/05*** | (2006.01) |
| ***A45C 5/00*** | (2006.01) |

(52) U.S. Cl.

CPC ..... *A45C 13/36* (2013.01); *A45C 5/00* (2013.01); *A45C 11/00* (2013.01); *B65D 81/055* (2013.01); *B65D 81/056* (2013.01); *A45C 2011/001* (2013.01); *A45C 2011/002* (2013.01); *A45C 2011/003* (2013.01)

(58) Field of Classification Search

CPC ..... A45C 13/36; A45C 5/00; A45C 11/00; A45C 2011/001; A45C 2011/002; A45C 2011/003; B65D 81/055; B65D 81/056

See application file for complete search history.

(56) References Cited

U.S. PATENT DOCUMENTS

| | | | | | |
|---|---|---|---|---|---|
| 10,334 | A | * | 12/1853 | Cantel | |
| 123,708 | A | * | 2/1872 | Kinne | |
| 480,709 | A | * | 8/1892 | Capitain | |
| 3,346,137 | A | * | 10/1967 | Ricci | B65D 21/0202 220/23.6 |
| 4,213,532 | A | | 7/1980 | Hans-Joachim | |
| 4,744,445 | A | * | 5/1988 | Anderson | A45C 5/02 190/107 |
| 4,813,542 | A | * | 3/1989 | Thompson | B65D 21/02 190/37 |
| 4,889,235 | A | * | 12/1989 | Hess | H04R 1/02 206/511 |

(Continued)

OTHER PUBLICATIONS

International Search Report dated May 28, 2019 in corresponding International application No. PCT/IB2018/059731 filed Dec. 6, 2018.

*Primary Examiner* — Tri M Mai

(74) *Attorney, Agent, or Firm* — Womble Bond Dickinson (US) LLP

(57) ABSTRACT

A corner bumper is adapted to be mounted to a corner of a substantially hard-sided carryable case, transport container, or the like, to act as a shock absorber for protecting the case and its contents from exterior impact. The bumper comprises intersecting wall portions to substantially cover the adjacent planes of a corner. The bumper includes feet elements to act as a base upon which the case can stand and space the base a distance from the underlying support surface.

9 Claims, 20 Drawing Sheets

(56) References Cited

U.S. PATENT DOCUMENTS

| | | | | |
|---|---|---|---|---|
| 6,930,881 | B2 * | 8/2005 | Karidis | G06F 1/1616 16/286 |
| 8,505,768 | B2 * | 8/2013 | Bardwell | B65D 43/16 220/832 |
| 9,089,964 | B2 * | 7/2015 | Cheng | B25H 3/02 |
| 2002/0166860 | A1 | 11/2002 | Giles et al. | |
| 2007/0138041 | A1 * | 6/2007 | Welsh | B25H 3/02 206/349 |

* cited by examiner

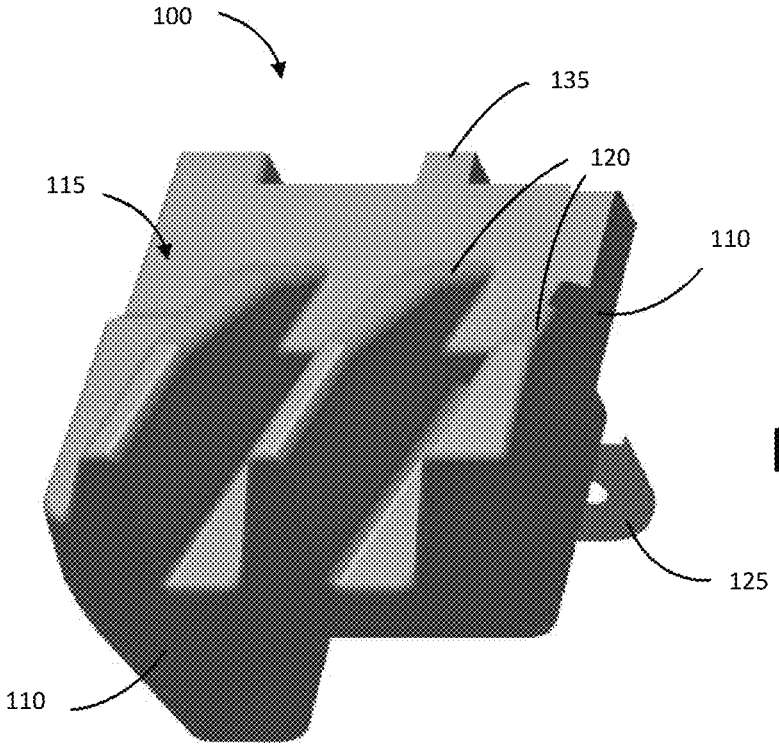
FIG. 1-A
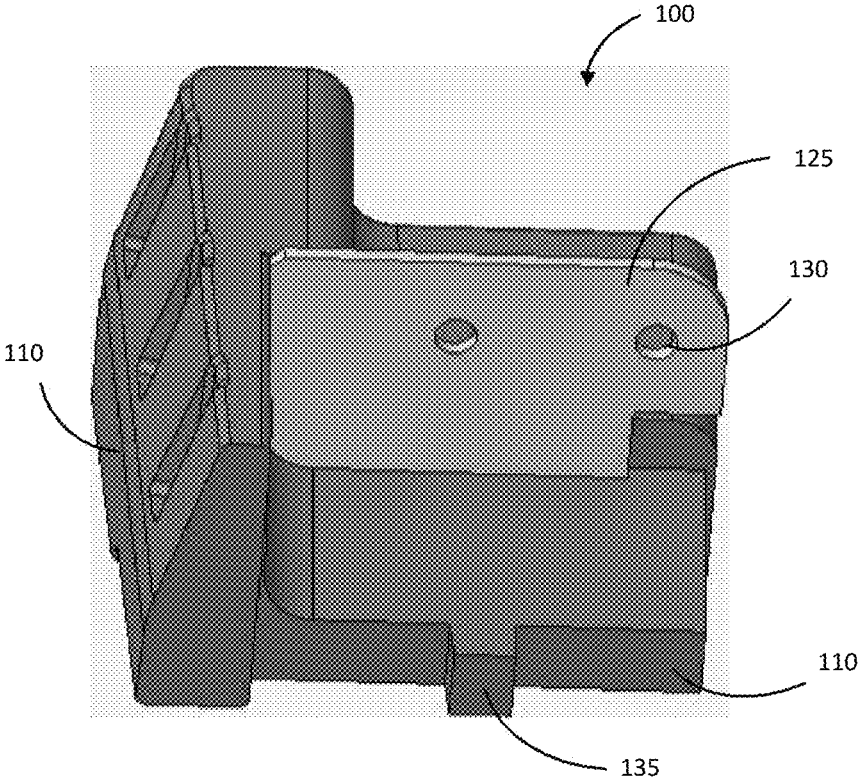
FIG. 1-B

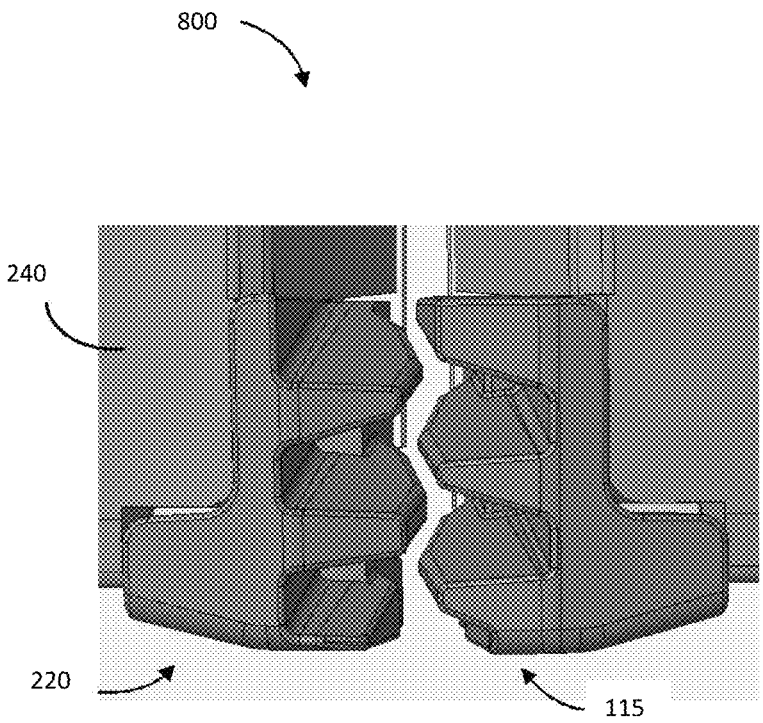
FIG. 8-A
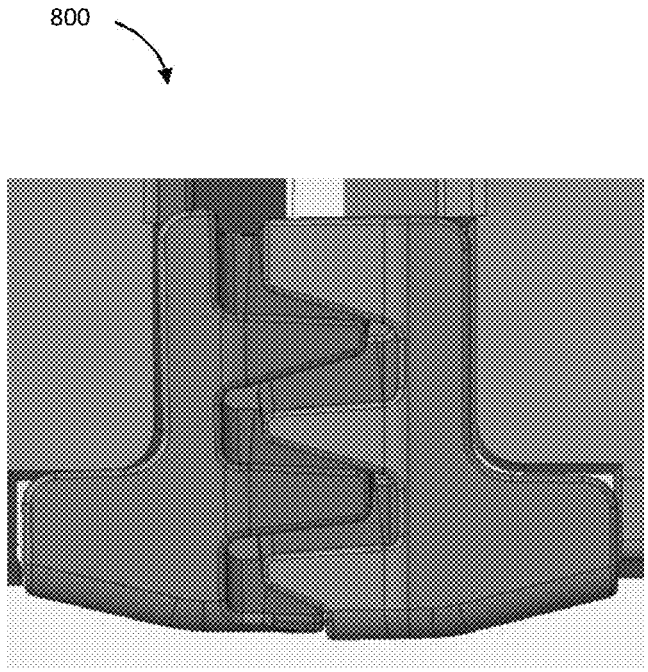
FIG. 8-B

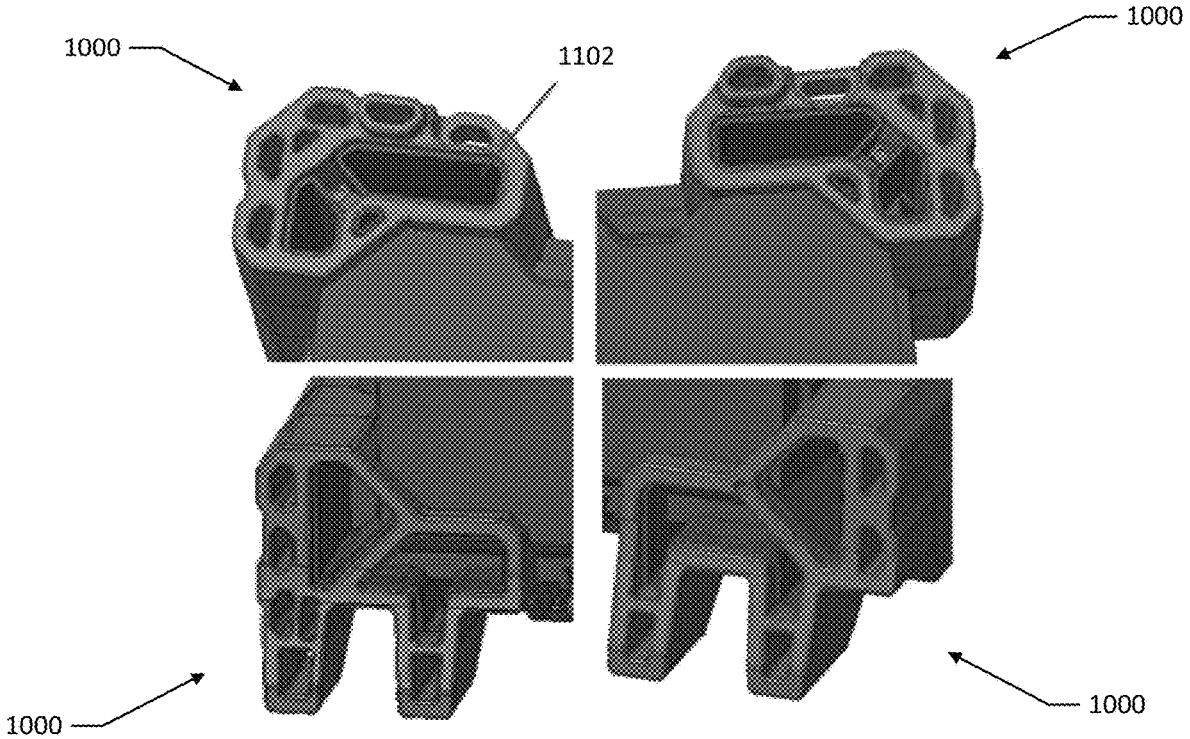
FIG. 10-A
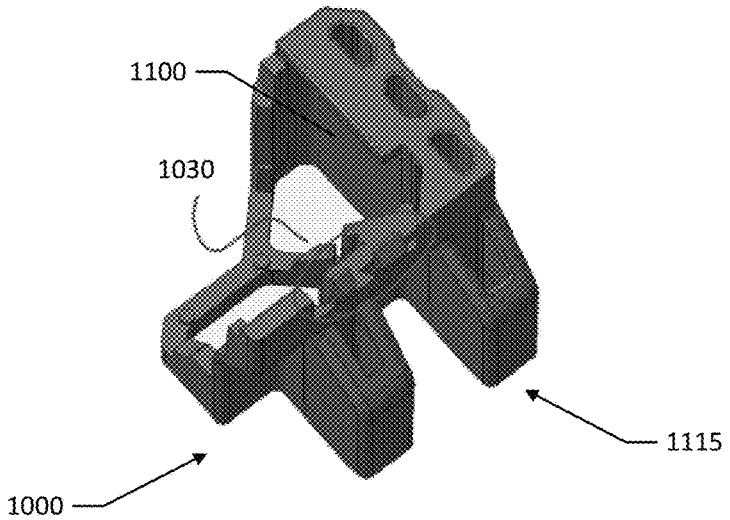
FIG. 10-B

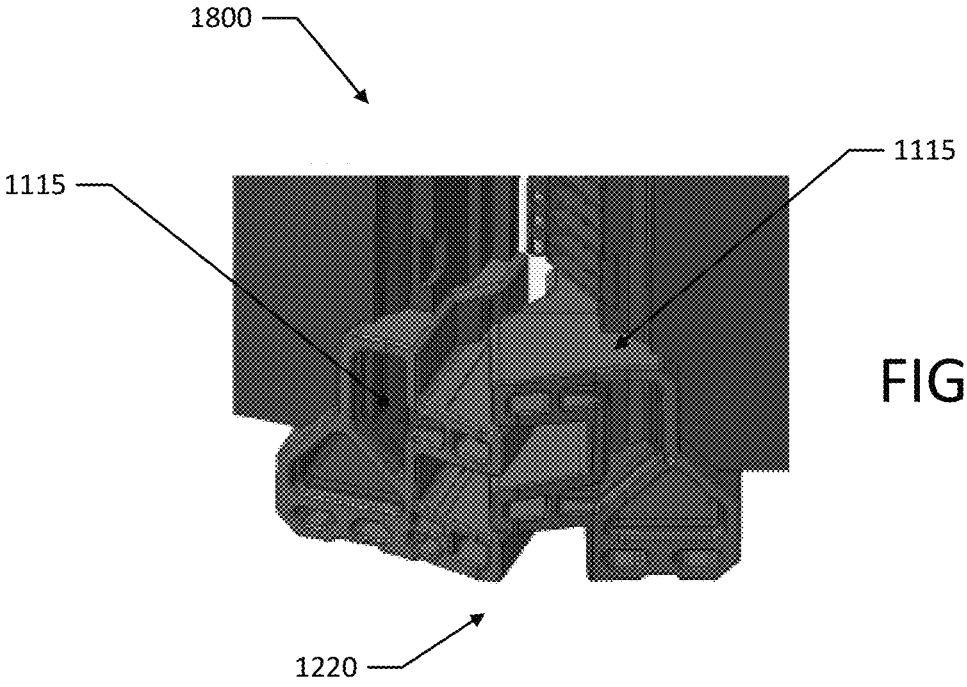
FIG. 17-A
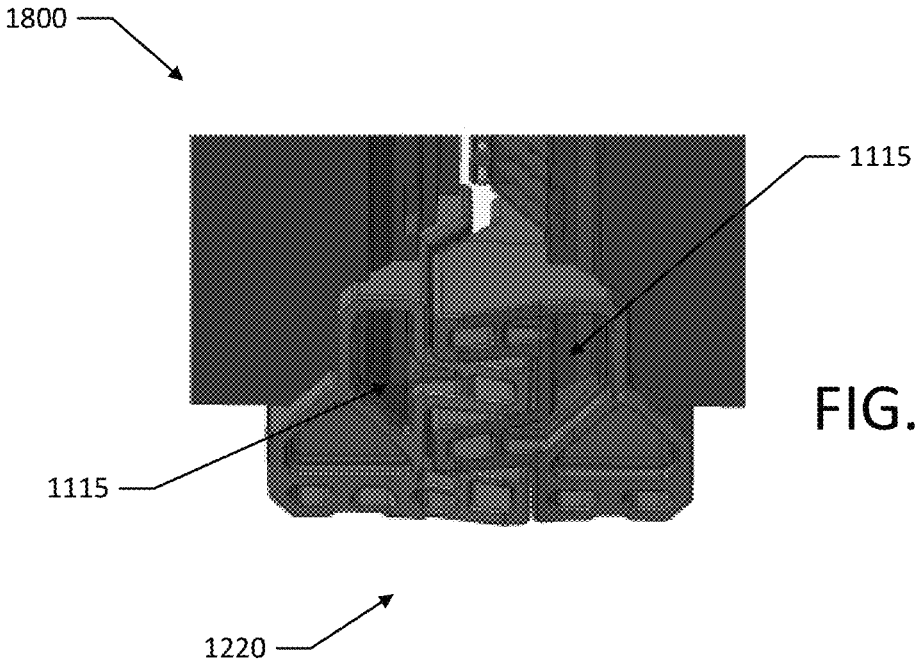
FIG. 17-B

CORNER BUMPER

CROSS-REFERENCE TO RELATED APPLICATION

The present application claims priority to U.S. Provisional Patent Application No. 62/595,639, entitled: Corner Bumper, filed on Dec. 7, 2017, the content of which is incorporated herein by reference.

TECHNOLOGICAL FIELD

Subject matter herein disclosed is generally directed to bumpers and, more particularly, corner bumpers for protecting a carryable case and contents therein from impact shock.

BACKGROUND

Bumpers or corner protectors for hard-sided transportable cases (e.g., carryable cases, transit cases, articles of luggage, and the like) are known. Bumpers ordinarily act as exterior-mounted elements to shield the case from damaging external force during use, and as shock absorbers to protect the contents of the case and the case itself from the shock of impact. Bumpers are especially important for cases enclosing fragile objects. Some types of transport cases, especially those housing electronic appliances, like photovoltaic panels, often require special attributes, such as an electrical cable-conveying hinge, and the ability to assume a flat profile when open. A bumper device that accommodates these features, as well as providing a stable base upon which the closed case can reside upright, would be beneficial.

BRIEF SUMMARY

Accordingly, the bumpers provided herein are adapted primarily to protect a hard-sided case and any articles contained therein from shock damage due to impact. Additionally, the disclosed bumpers allow the case to open to a completely prone posture when disposed on a substantially flat surface, and also furnish a stable pedestal for the case to stand upright in the closed configuration.

The corner bumper herein described comprises generally a unitary body with three intersecting side walls adapted to be mounted to the exterior corner of a substantially hard-sided case or container. Preferably, the bumper side walls extend for a distance beyond the exterior surface of the case in order to absorb impact. Preferably, the bumper includes one or more projections extending from the side wall proximate to the base wall of the case underlying surface upon which the case may reside, to act as feet to separate the case from said underlying surface and provide a stable base thereon.

The present disclosure provides a corner bumper configured to be affixed to the corner of a carryable case, container, or the like, and act as a shock absorber for alleviating damage to the case and its contents from outside impact. In one embodiment, the corner bumper may comprise at least three adjacent, intersecting wall portions, at least one wall portion having one or more feet elements that extend from the base of the case, thereby protecting the base from impact damage and providing a stable platform on which the case may be disposed upon a support surface, at least one wall portion that is configured to abut a neighboring bumper wall portion in order to transfer impact force to the neighboring bumper, whereby impact force may be dissipated, and at least one wall portion having at least one extension that is configured to stabilize components within the case housing. The one or more feet elements may be configured to mesh with feet elements of a neighboring bumper, whereby the case side portions may be opened to assume a common plane. In some embodiments, the one or more feet elements may comprise one or more denticulate feet components. In some embodiments, the one or more denticulate feet elements may comprise at least two-prong foot elements. In some embodiments, the corner bumper may be configured to be mechanically affixed to an exterior of a carryable case. In some embodiments, the corner bumper may be configured to be affixed to an exterior of a carryable case using one or more of screws, rivets, bolts, pins, adhesives, clips, snap-on elements, and combinations thereof. Some embodiments further comprise a metallic securing plate that includes one or more mounting through-holes configured for receiving a fastening article. In some embodiments, the corner bumper may be configured to be removably affixed to an exterior of a carryable case. In some embodiments, the corner bumper may be configured to be integrally molded with a housing of a carryable case. Some embodiments may further comprise one or more internal air-filled cavities.

The present disclosure also provides a carryable case configured to house at least one electronic apparatus. In one embodiment, the carryable case may comprise a pair of side portions joined together at one respective end thereof, each side portion comprising four corners and being openable with respect to the other, a corner bumper configured to be affixed to at least one of the corners of each side portion, the corner bumper comprising at least three adjacent, intersecting wall portions, at least one wall portion having one or more feet elements that extend from the base of the case, thereby protecting the base from impact damage and providing a stable platform on which the case may be disposed upon a support surface, at least one wall portion that is configured to abut a neighboring bumper wall portion in order to transfer impact force to the neighboring bumper, whereby impact force may be dissipated, and at least one wall portion having at least one extension configured to stabilize components within the case housing, wherein the one or more feet elements are configured to mesh with feet elements of a neighboring bumper, whereby the case halves may be open to a assume a common plane. In some embodiments, the one or more feet elements of the corner bumper may comprise one or more denticulate feet components. In some embodiments, the one or more denticulate feet elements of the corner bumper may comprise at least two-prong foot elements. In some embodiments, the corner bumper may be configured to be mechanically affixed to the exterior of the side portion. In some embodiments, the corner bumper may be configured to be affixed to the exterior of the side portion using one or more of screws, rivets, bolts, pins, adhesives, clips, snap-on elements, and combinations thereof. In some embodiments, the corner bumper may further comprise a metallic securing plate that includes one or more mounting through-holes configured for receiving fastening articles. In some embodiments, the corner bumper may be configured to be removably affixed to the side portion. In some embodiments, the corner bumper may be configured to be integrally molded with the side portion. In some embodiments, the corner bumper may further comprise one or more internal air-filled cavities. In some embodiments, the corner bumper may be configured to mesh with a corner bumper of another carryable case in order to facilitate stable stacking in a horizontal stacking orientation. In some embodiments, the corner bumper may be configured to intersect with a corner bumper of another carryable case in order to facilitate stable stacking in a vertical stacking orientation.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The features of the present disclosure, together with the advantages thereof may be best understood by reference to the following description taken in conjunction with the accompanying drawings, wherein like reference characters identify like elements, and wherein:

FIG. 1-A is an elevated bottom perspective view of an exemplary bumper according to at least one embodiment of the present disclosure;

FIG. 1-B is an elevated top perspective view of an exemplary bumper according to at least one embodiment of the present disclosure;

FIG. 8-A is an elevated side perspective view of an exemplary set of corner bumpers, according to at least one embodiment of the present disclosure, installed on the base corners of an illustrative carryable case in a nearly fully open position;

FIG. 8-B is an elevated side perspective view of an exemplary set of corner bumpers, according to at least one embodiment of the present disclosure, installed on the base corners of an illustrative carryable case in a fully open position;

FIG. 10-A is an elevated top perspective view an exemplary set of corner bumpers, according to at least one embodiment of the present disclosure, installed on the corners of an illustrative carryable case;

FIG. 10-B is an elevated bottom perspective view of an exemplary bumper according to at least one embodiment of the present disclosure;

FIG. 17-A is an elevated side perspective view of an exemplary set of corner bumpers, according to at least one embodiment of the present disclosure, installed on the base corners of an illustrative carryable case in a nearly fully open position;

FIG. 17-B is an elevated side perspective view of an exemplary set of corner bumpers, according to at least one embodiment of the present disclosure, installed on the base corners of an illustrative carryable case in a fully open position;

DETAILED DESCRIPTION

So that the embodiments presented herein may be readily understood, certain terms are first defined. It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting, such that other embodiments may be used and changes may be made without departing from the spirit and scope of the described embodiments.

Figure 2:
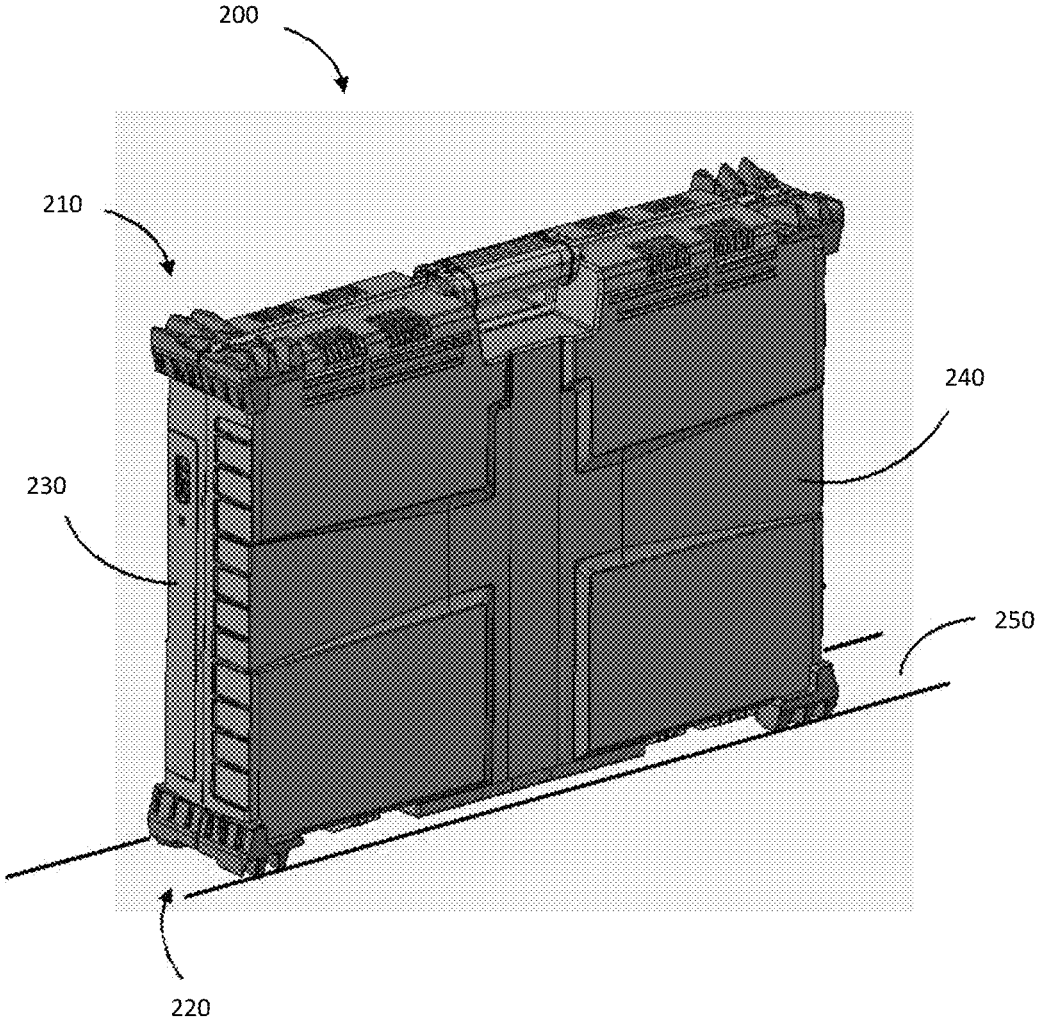
FIG. 2 shows an exemplary set of corner bumpers, according to at least one embodiment of the present disclosure, installed on an illustrative carryable case.
Figure 11:
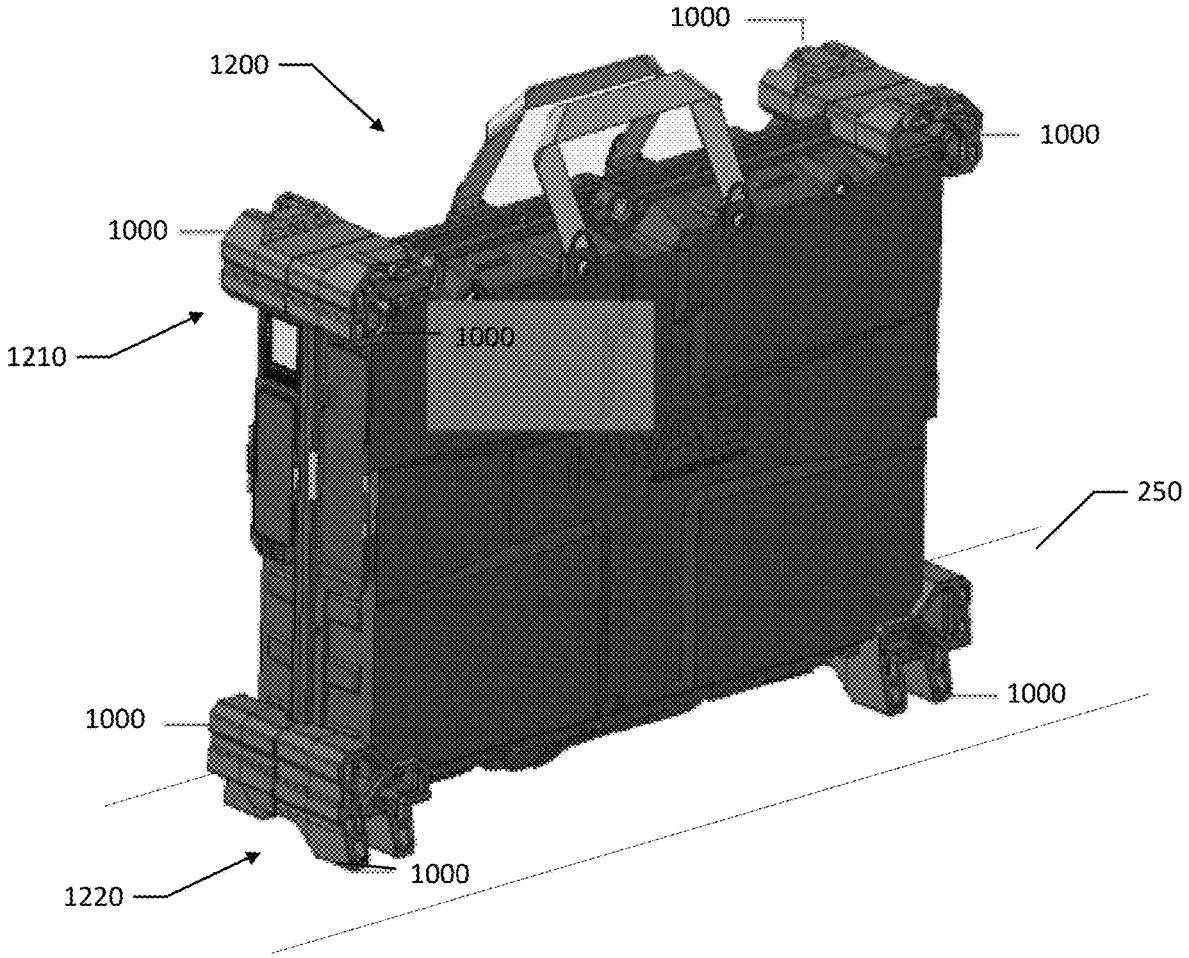
FIG. 11 shows an exemplary set of corner bumpers, according to at least one embodiment of the present disclosure, installed on an illustrative carryable case.

In the drawings, FIG. 1-(A, B) set forth an exemplary corner bumper 100 in accordance with at least some embodiments of the present inventive concept. Another embodiment of an exemplary set of corner bumpers 1000 is shown in FIG. 10-(A, B). The bumpers described herein are adapted generally for protecting a carryable or transportable case, and contents therein, from potentially damaging shock from impact. In FIG. 2 is shown a set of exemplary bumpers 210, 220 installed on an illustrative carryable case. Likewise, in FIG. 11 is shown a set of exemplary bumpers 1210, 1220 installed on a similar illustrative carryable case. Although the described bumpers are applicable to an assortment of cases, such as transport cases, shipping containers, and articles of luggage, they are particularly suitable for cases containing fragile or delicate items, such as electronic appliances or scientific/technical instruments. Such containers may require enhanced measures to ruggedize them against collision damage.

In FIG. 2 (which illustrates a case 200 with corner bumpers in the form of top bumpers 210 and base bumpers 220 of one embodiment), and FIG. 11 (which illustrates a case 1200 with corner bumpers in the form of top bumpers 1210 and base bumpers 1220 of another embodiment) the bumpers are shown applied to each of the eight exterior corners of the depicted case. The bumpers disclosed may be applied to any or all corners of a case, depending upon the level of protection desired or other considerations. Applying bumpers to all eight corners provides the maximum impact protection. Alternately, bumpers may be installed only to the corners on which the case will rest on the underlying surface (base corners). For example, for a suitcase-like case, such as depicted in FIGS. 2 and 11, bumpers may be applied to the base corners only in order to absorb shock when the closed case is disposed on an underlying surface 250 in an upright position.

With reference again to FIGS. 1-(A, B) and FIG. 10-(A, B), the exemplary bumper 100 and the exemplary bumper 1000 depicted is a unitary body in general aspect, comprising three substantially intersecting walls 110, 1100, configured to be mounted to a rigid corner composed of three intersecting walls, thereby protecting the corner from impact to each or any of the three exposed walls. The wall sections of the bumper may be configured in alternate embodiments to that shown in FIGS. 1-(A, B) and FIG. 10-(A, B), in order to accommodate a variety of case corner configurations, such as rounded or curved edges and corners.

Construction of the bumper may vary within the limits of the present disclosure, but is preferably robust in order to resist impact. Ideally, wall sections are of suitable dimensions to be durable and withstand repeated collisions. As shown, e.g., in FIGS. 2, 4, 7, and FIGS. 11, 13, 16 the bumper walls are preferably of such dimensions that they overhang the side walls of the case, so that any impinging force impacts the bumper rather than the case itself. A prominent feature of the exemplary bumper 100 depicted in FIG. 1-A and the exemplary bumper 1000 of FIG. 10-B is the denticulate feet component (e.g., a bumper foot 115 of FIG. 1-A and a bumper foot 1115 of FIG. 10-B) which comprises a support base. (see also, e.g., FIG. 3 and FIG. 12). Preferably, the feet elements are configured to furnish a sturdy and stable base or platform for the case to rest thereupon. (see e.g., FIG. 2 and FIG. 11). Ideally, the feet should extend from the case housing to a distance sufficient to properly protect the base wall of the case from impact. It will be recognized that the denticulate feet of a bumper will advantageously interlock or mesh with the feet of an opposing bumper when the case is in the fully opened position. (see e.g., FIG. 4 and FIG. 13). This feature permits the feet to be of sufficient length to adequately space the underside elements of the case from the underlying support surface 250 (e.g., ground, floor, etc.), while allowing the symmetrical case halves to open to the extent of sharing a common plane. Although the exemplary bumper of FIGS. 1-A, and 3 displays a three-pronged foot element (e.g., three foot prongs 120), other quantities, as well as shapes, of individual prongs may be implemented. For example, the exemplary bumper of FIGS. 10-A, and 12 displays a two-prong foot element.

The bumper described herein may be adapted to be mechanically affixed to the exterior case housing in a variety of conventional fashions, including fasteners of various sorts (e.g., screws, rivets, bolts, pins, and the like), adhesives, and snap-on elements, among others. The exemplary bumper 100 shown in FIG. 1-(A, B), includes a metallic securing plate 125 with mounting through-holes 130 for receiving screws or other fastening articles whereby the bumper 100 may be secured to the case. In alternate embodiments, through-holes may be disposed at other locations. If desired, the bumper may be removably fastened to the case, permitting a damaged, or otherwise defective, bumper to be readily replaced. In an alternative embodiment, the bumper may be molded integrally with the case housing. The exemplary bumpers 1000 shown in FIG. 10-(A, B) include one or more snap features or clips 1030 that are configured to engage respective portions of the corners of a carryable case in order to hold the bumpers in place. For example, the exemplary bumpers 1000 shown in FIG. 10-(A, B) are configured to slide onto the respective corners (such as by sliding along or engaging one or more base features 1102) of the carryable case and snap into place, although fasteners may also be used.

The described bumper may be made of a variety of appropriate materials that display resilient and shock-absorbing attributes including, but not restricted to, thermoplastic elastomers (TPE), synthetic rubbers, polyesters, polyurethane, polyolefins, nylon, and acrylic polymers. Fabrication of the bumper may be accomplished rapidly and cost-effectively by injection molding or other methods. Embodiments may also be contemplated wherein the bumper is fabricated with one or more internal air-filled cavities in order to provide increased compressibility and cushioning capacity upon impact. It will be recognized that some exemplary bumper embodiments comprise mirror images of a single design, affording the ability to accommodate all eight case corners with two structural variants. (see FIG. 1-(A,B)). This feature may reduce tooling requirements for manufacture. Use of a single form that could be fitted to all corners may also be contemplated. In other embodiments, such as the bumper 1000 of FIG. 10-(A, B) each corner bumper or sets of corner bumpers may have a unique configuration. For example, in the depicted embodiment the base corner bumpers 1220 are wider than the top corner bumpers 1210 and have different configurations.

Figure 19:
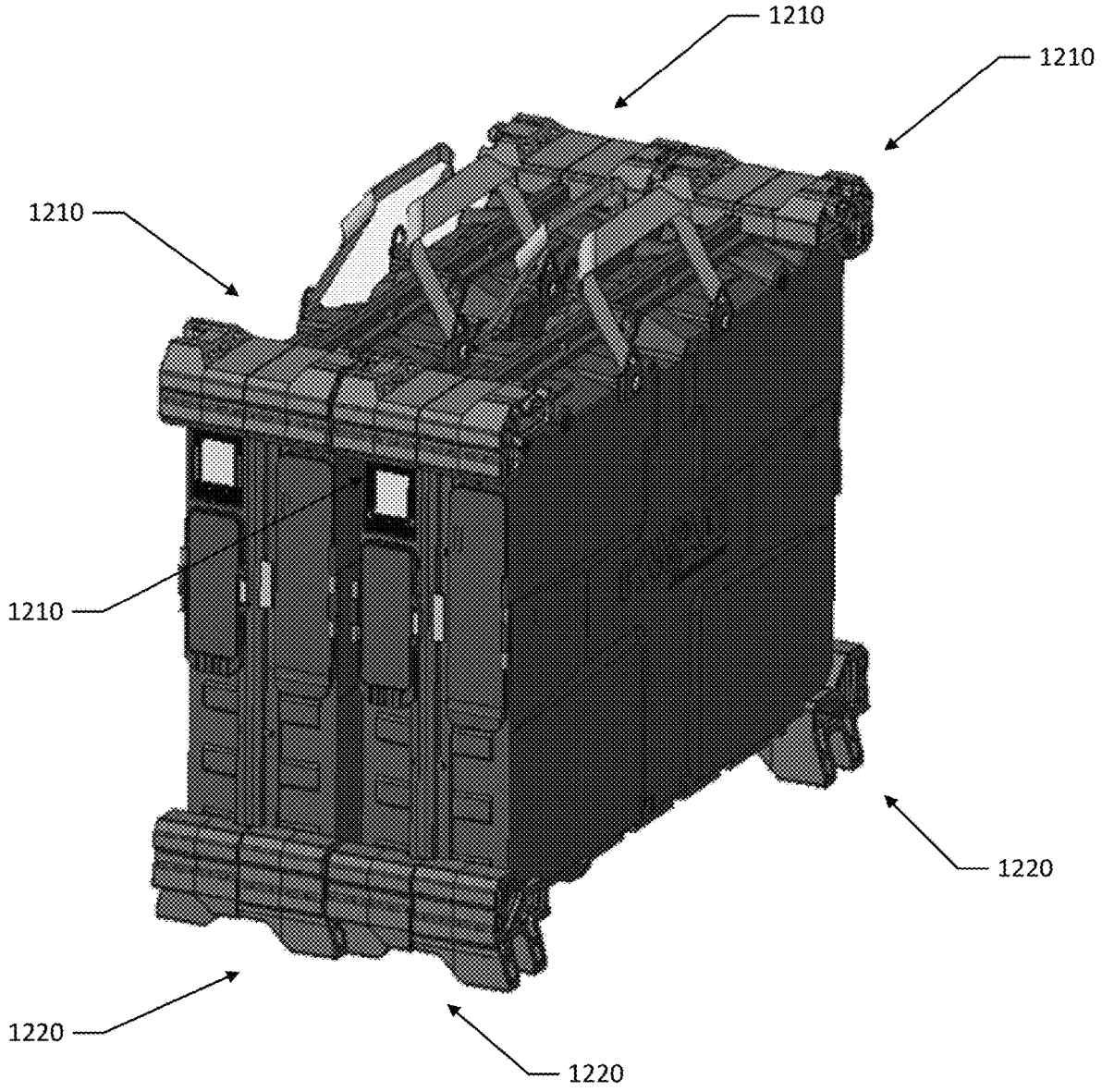
FIG. 19 shows an exemplary set of corner bumpers, according to at least one embodiment of the present disclosure, installed on a pair of illustrative carryable cases that are stacked together in an upright configuration.
Figure 20:
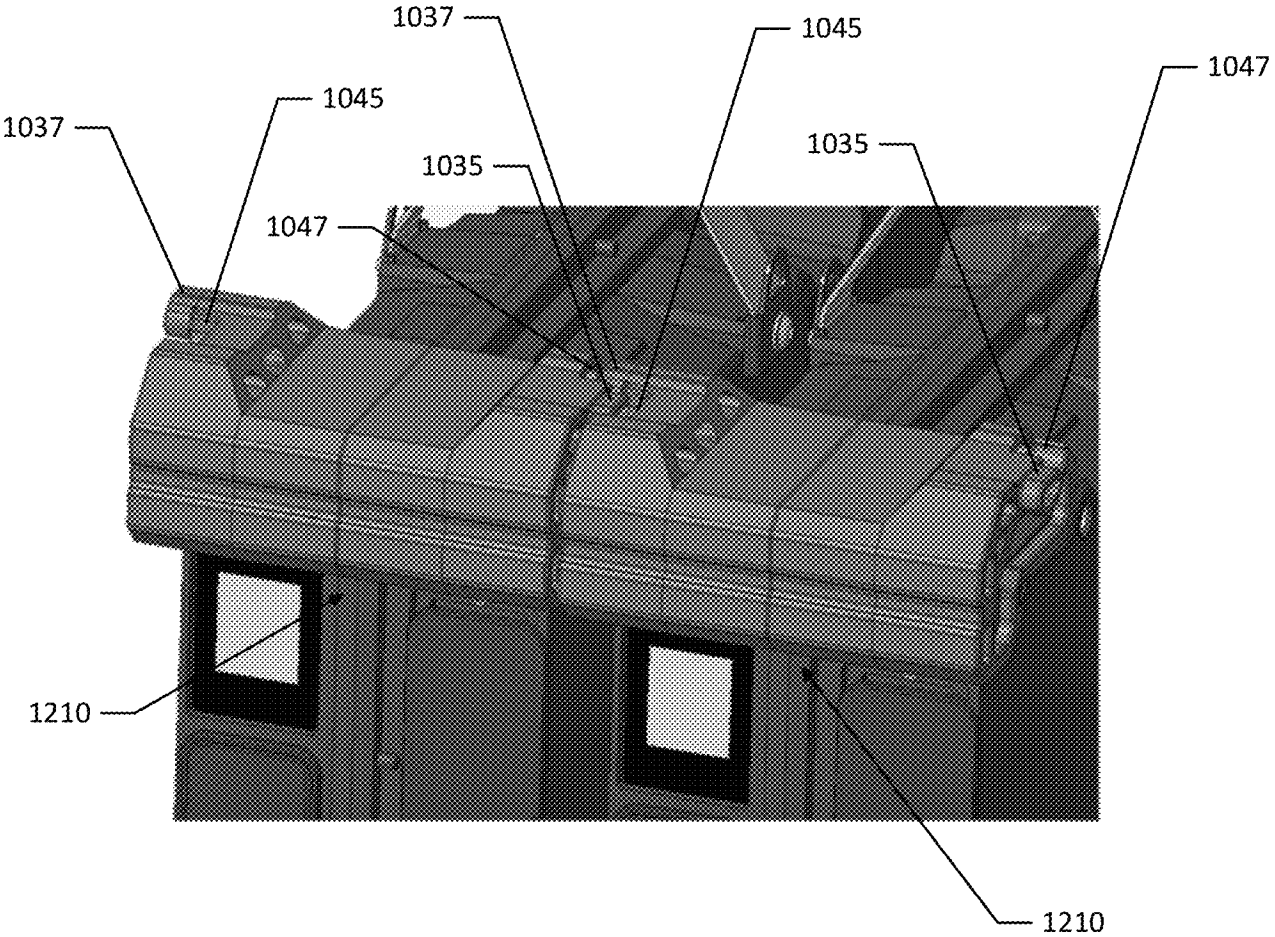
FIG. 20 shows an elevated top perspective view of nested corner bumpers of a pair of illustrative carryable cases that are stacked together.
Figure 21:
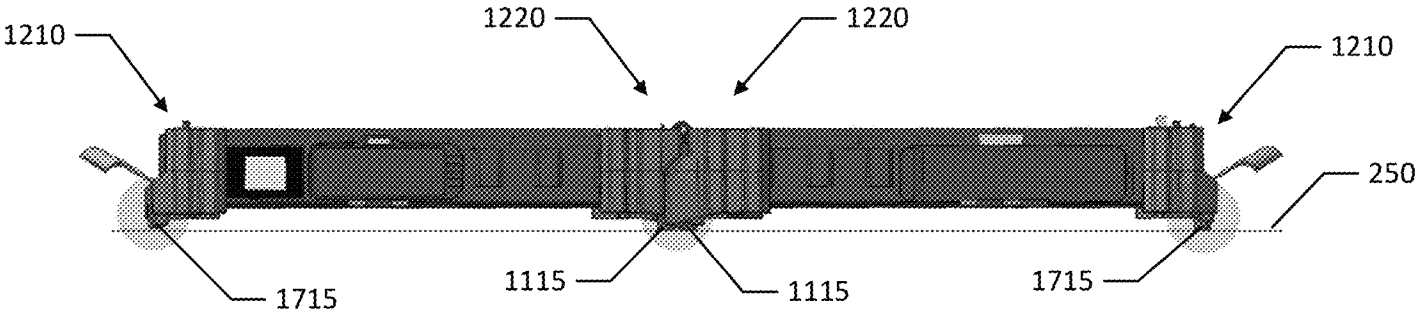
FIG. 21 shows a side view of shows an exemplary set of corner bumpers, according to at least one embodiment of the present disclosure, installed on an illustrative carryable case in an open position.

Turning now to function and operation of the disclosed corner bumper, the present inventive concept is a device adapted for shielding a case or container, and any contents therein, from the shock of impact. Although the described bumpers protect the case corners in particular, collision protection extends to all exterior surfaces of the case, including edges and side panels, provided that bumpers are applied to all corners of the case. Protection is also afforded regardless of the position of the case, relative to the underlying surface, or whether the case is open or closed. Advantageously, the bumper side walls extend beyond the outside case wall surfaces, such that the case surface is spaced from the underlying support surface when disposed thereon, thereby preventing direct contact. (see FIGS. 2, 7 and FIGS. 11, 16). In some embodiments, the bumper side walls, especially those coinciding with the side panels of the case, may also include stacking aid means, such as ridges, grooves, projections, and the like, to assist in aligning and securing two or more cases in a stack. Such stacking aid means may be useful when, for instance, two or more cases are being transported in a vehicle. The stacking aid would enable a plurality of cases to maintain a stable stack configuration. In some embodiments, the corner bumpers may be configured to facilitate stable stacking of a plurality of closed cases in an upright (e.g., with respect to a support surface) and horizontal (e.g., side-by-side) stacking configuration, such as by interlocking or meshing corner bumpers of adjacent cases. For example, FIG. 19 shows a pair of illustrative carryable cases that are stacked together in an upright and horizontal configuration, with base bumpers 1220 and top bumpers 1210 of neighboring cases nested together. FIG. 20 shows a close-up of the top bumpers 1210 of neighboring cases nested together. Each of the top bumpers 1210 includes a pair of protrusion features 1035, 1037 that extend laterally from the bumper 1210 and a pair of corresponding recesses 1045, 1047 that are configured to receive neighboring protrusion features 1035, 1037. The corner bumpers of a plurality of closed cases may also be configured to facilitate stable stacking in a flat (e.g., substantially parallel to a support surface) and vertical (e.g., one on top of another) stacking orientation, such as by interlocking or meshing corner bumpers of adjacent cases. As shown in FIG. 21, one or both of the protrusions features 1035, 1037 of the top bumpers 1210, and a portion of the bumper feet 1115 of the base bumpers 1220, may act to position the carryable case above a support surface 250 in an open position. This may allow air to flow below the carryable case, which may improve its thermal characteristics (e.g., by providing increased cooling of electronic appliances that may be operating inside the case).

Figure 5:
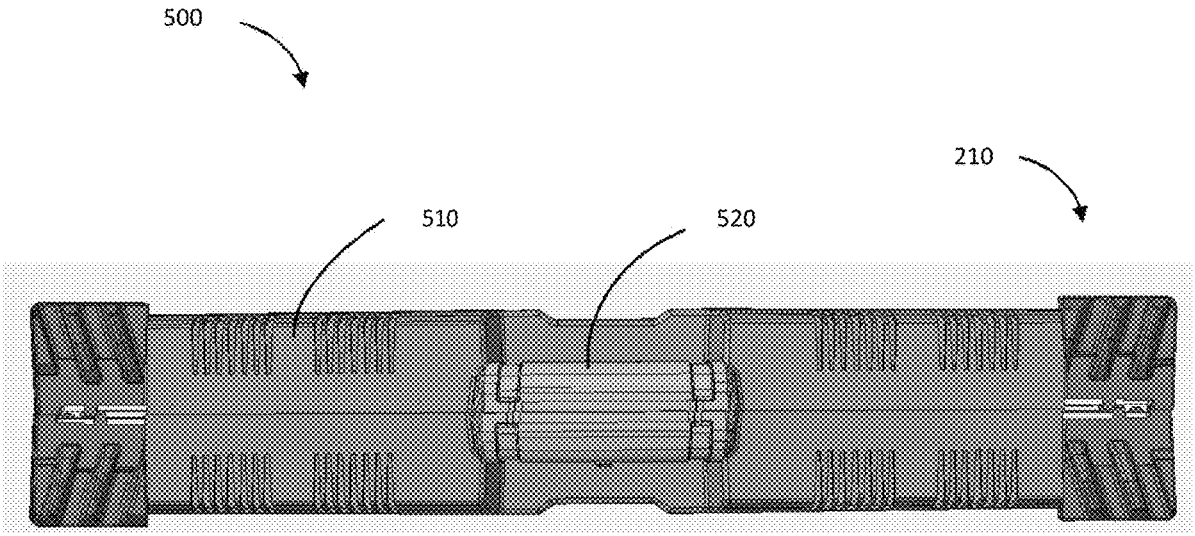
FIG. 5 is an elevated view of an exemplary set of corner bumpers, according to at least one embodiment of the present disclosure, installed on the upper corners of an illustrative carryable case in a closed position.
Figure 14:
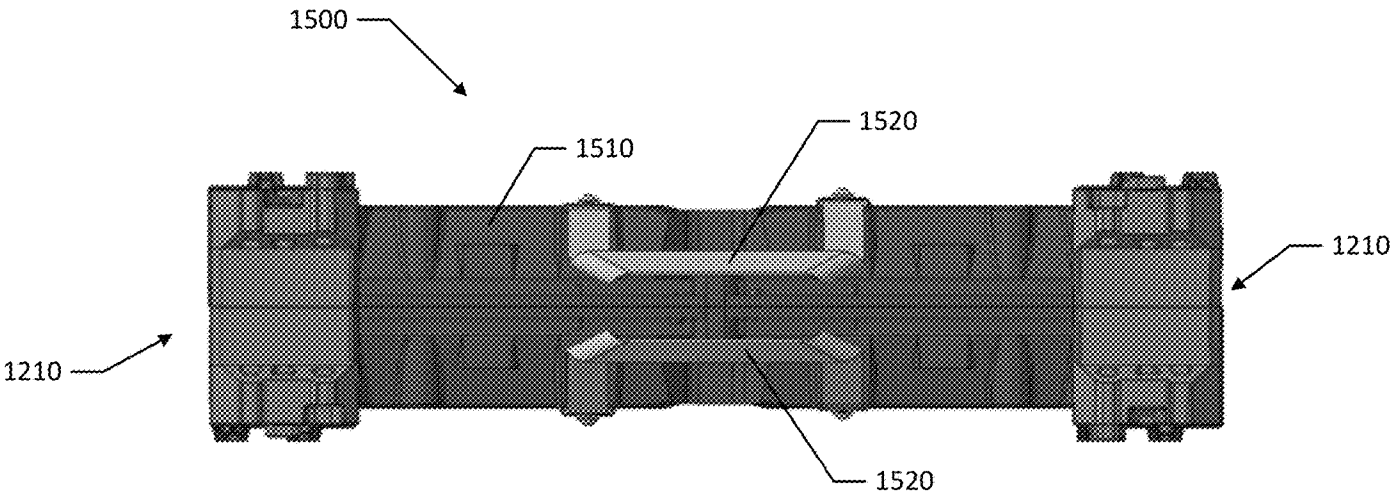
FIG. 14 is an elevated view of an exemplary set of corner bumpers, according to at least one embodiment of the present disclosure, installed on the upper corners of an illustrative carryable case in a closed position.

The feet extensions of the disclosed bumper furnish added protection to the top and bottom panels of a carryable case where components especially vulnerable to collision may reside. For instance, carryable cases resembling articles of hard-side luggage typically have a carrying handle or hand grip disposed at one end panel, as well as clasps or other mechanical means for holding the two halves of the case together in the closed position, as depicted in the exemplary case of FIG. 5, which illustrates a case 500 with top bumpers 210, and as depicted in the exemplary case of FIG. 14, which illustrates a case 1500 with top bumpers 1210. The disclosed bumpers act to guard the handle 520 of FIG. 5, and handles 1520 of FIG. 14, respectively, and other elements (such as, for example, the top panels 510 of FIG. 5 and top panels 1510 of FIG. 14, respectively) from impact.

Figure 6:
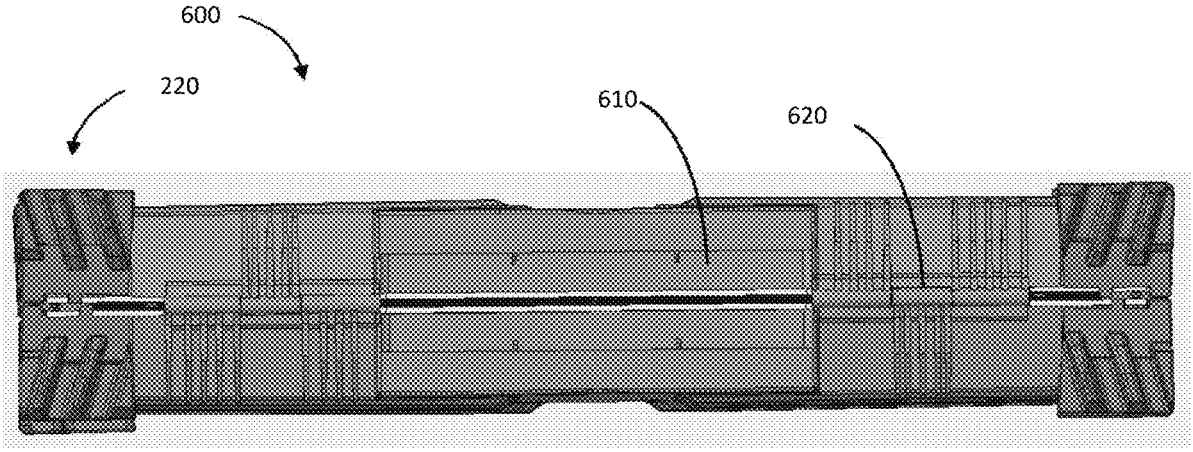
FIG. 6 is an elevated view of an exemplary set of corner bumpers, according to at least one embodiment of the present disclosure, installed on the base corners of an illustrative carryable case in a closed position.
Figure 7:
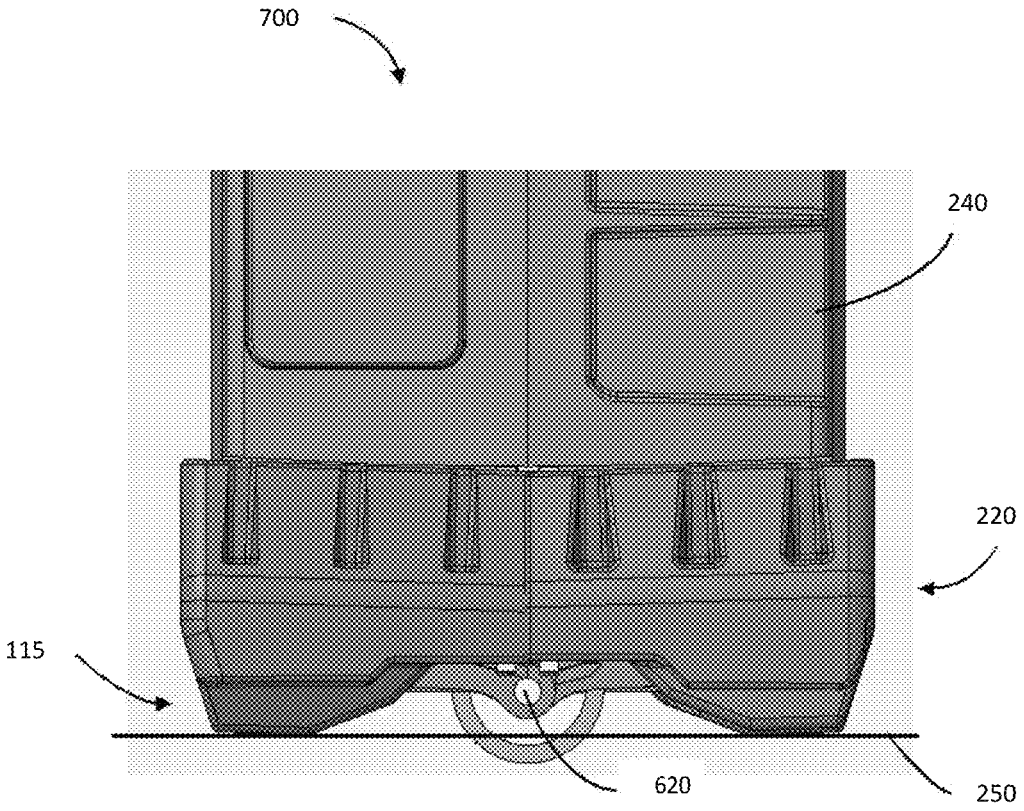
FIG. 7 is an elevated side view of an exemplary set of corner bumpers, according to at least one embodiment of the present disclosure, installed on the base corners of an illustrative carryable case in a closed position.
Figure 15:
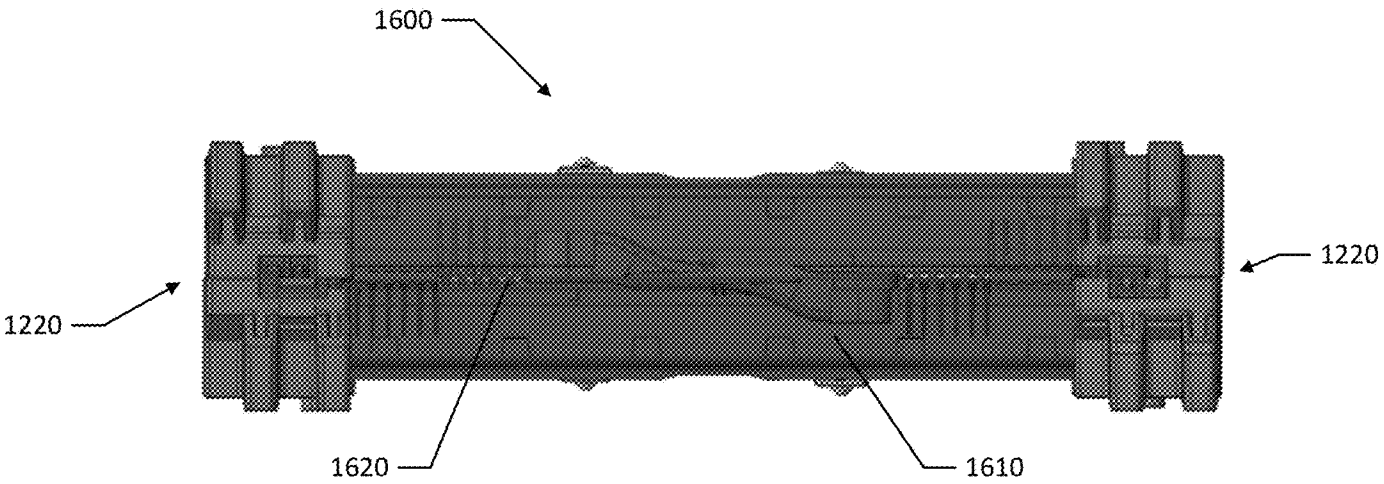
FIG. 15 is an elevated view of an exemplary set of corner bumpers, according to at least one embodiment of the present disclosure, installed on the base corners of an illustrative carryable case in a closed position.
Figure 16:
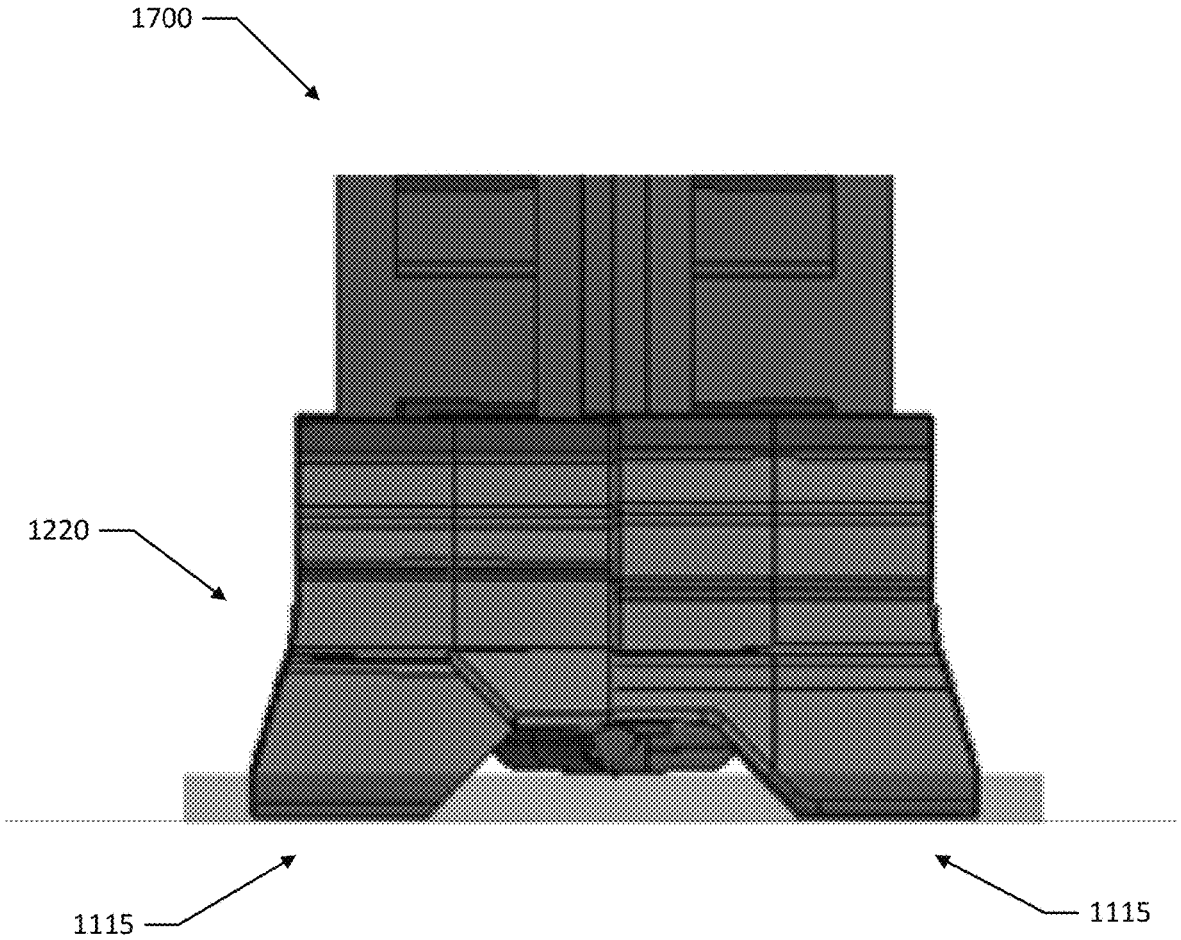
FIG. 16 is an elevated side view of an exemplary set of corner bumpers, according to at least one embodiment of the present disclosure, installed on the base corners of an illustrative carryable case in a closed position.

The bottom case panels 610 and 1610, likewise, may also feature exposed components, notably a hinge 620 and 1620 for coupling the two halves of the case, which require enhanced protection. (see FIG. 6, which illustrates a case 600 with base bumpers 220 and FIG. 15, which illustrates a case 1600 with base bumpers 1220). With some specialized carryable cases, such as those housing electronic apparatus, there may be a need to permanently pass electrical cables from one of the case halves to the other in order to link electronic components. This feature is often required in cases accommodating photovoltaic panels. One approach to achieve this implementation is to employ a hollow hinge (or other pass-through element), which acts as a conduit to receive and pass electrical wires from one side of the case to the other. Such hinges may, of necessity, need to be disposed between the halves of a symmetrical case and may also tend to be larger in diameter than conventional hinges, such that they may protrude from the bottom case panel, rendering them especially susceptible to impact. The feet elements of the disclosed bumper prevent this problem by extending from the case base panel so that the hinge remains spaced from the underlying support surface and avoids direct contact therewith when the closed case is disposed upright upon its base on a surface. (see FIGS. 2, 7, which illustrate a case 200 with top bumpers 210 and base bumpers 220 (FIG. 2) and a case 700 with base bumpers 220 (FIG. 7), see also FIGS. 11, 16, which illustrate a case 1200 with top bumpers 1210 and base bumpers 1220 (FIG. 11), and a case 1700 with base bumpers 1220 (FIG. 16)).

In addition to shielding the base of the case from impact damage, the feet components also serve to provide a stable platform on which the case can stand upright when in the closed configuration and residing upon an underlying support surface, such as the ground or floor. The implementation of the exemplary bumper described herein may be modified; however, the feet are ideally of suitable dimensions, design, and material construction that they reasonably resist case toppling.

Figure 4:
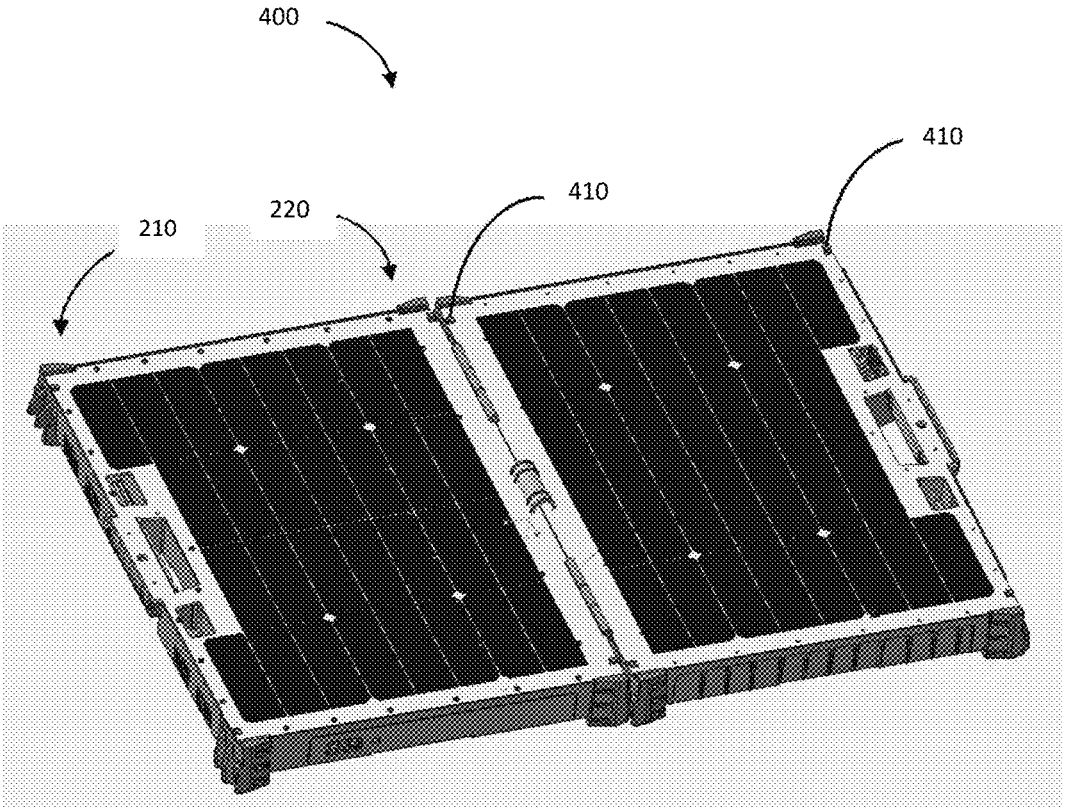
FIG. 4 shows an exemplary set of corner bumpers, according to at least one embodiment of the present disclosure, installed on an illustrative carryable case in an open position.

It will be noted that in other designs the extended feet elements on opposing base bumpers could impinge on one another and interfere with the case being open completely. Beneficially, as shown in FIG. 4, which illustrates a case 400 with corner bumpers in an open position, and FIG. 13, which illustrates a case 1400 with corner bumpers in an open position, the described bumper includes serrate feet configured to interlock with the feet of the opposite base bumper when the case halves are separated 180° from each other, thereby allowing the feet components to nest within each other. (see FIG. 8-(A, B), which illustrate a case 800 with intersecting base bumpers 220, and FIG. 17-(A, B), which illustrate a case 1800 with interlocking base bumpers 1220). Such a configuration may also help transfer absorbed impacts in the open configuration.

Figure 3:
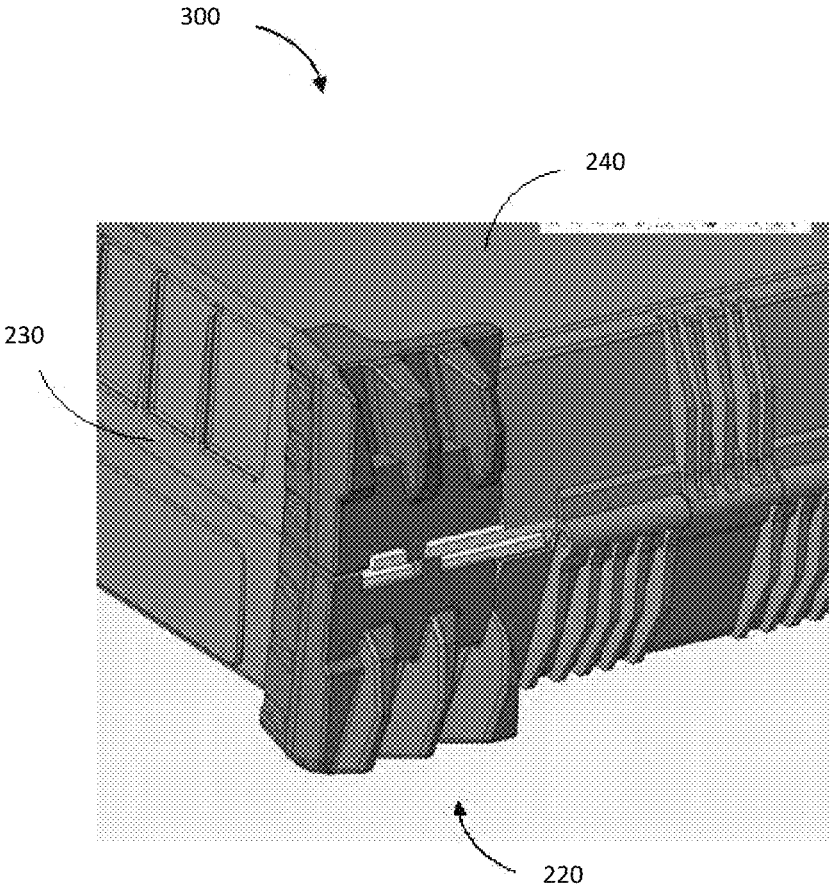
FIG. 3 is a bottom perspective view of exemplary bumpers, according to at least one embodiment of the present disclosure, installed on the base corners of an illustrative carryable case in the closed position.
Figure 12:
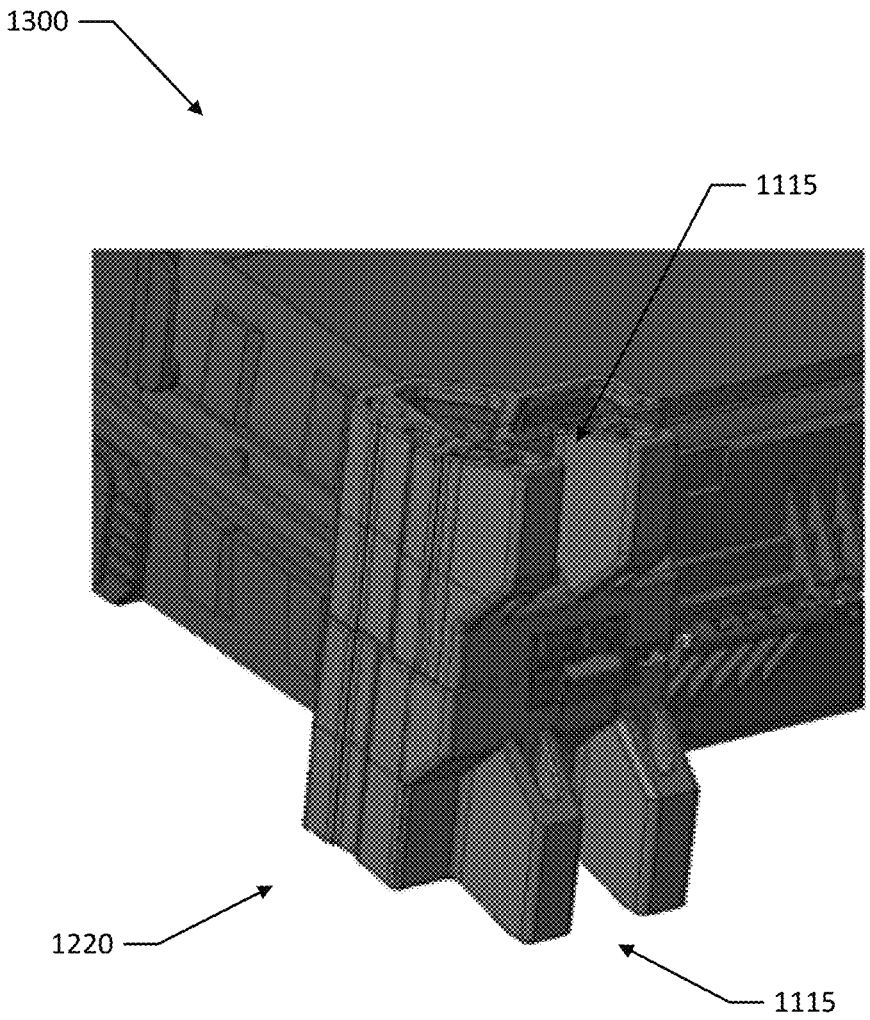
FIG. 12 is a bottom perspective view of exemplary bumpers, according to at least one embodiment of the present disclosure, installed on the base corners of an illustrative carryable case in the closed position.
Figure 13:
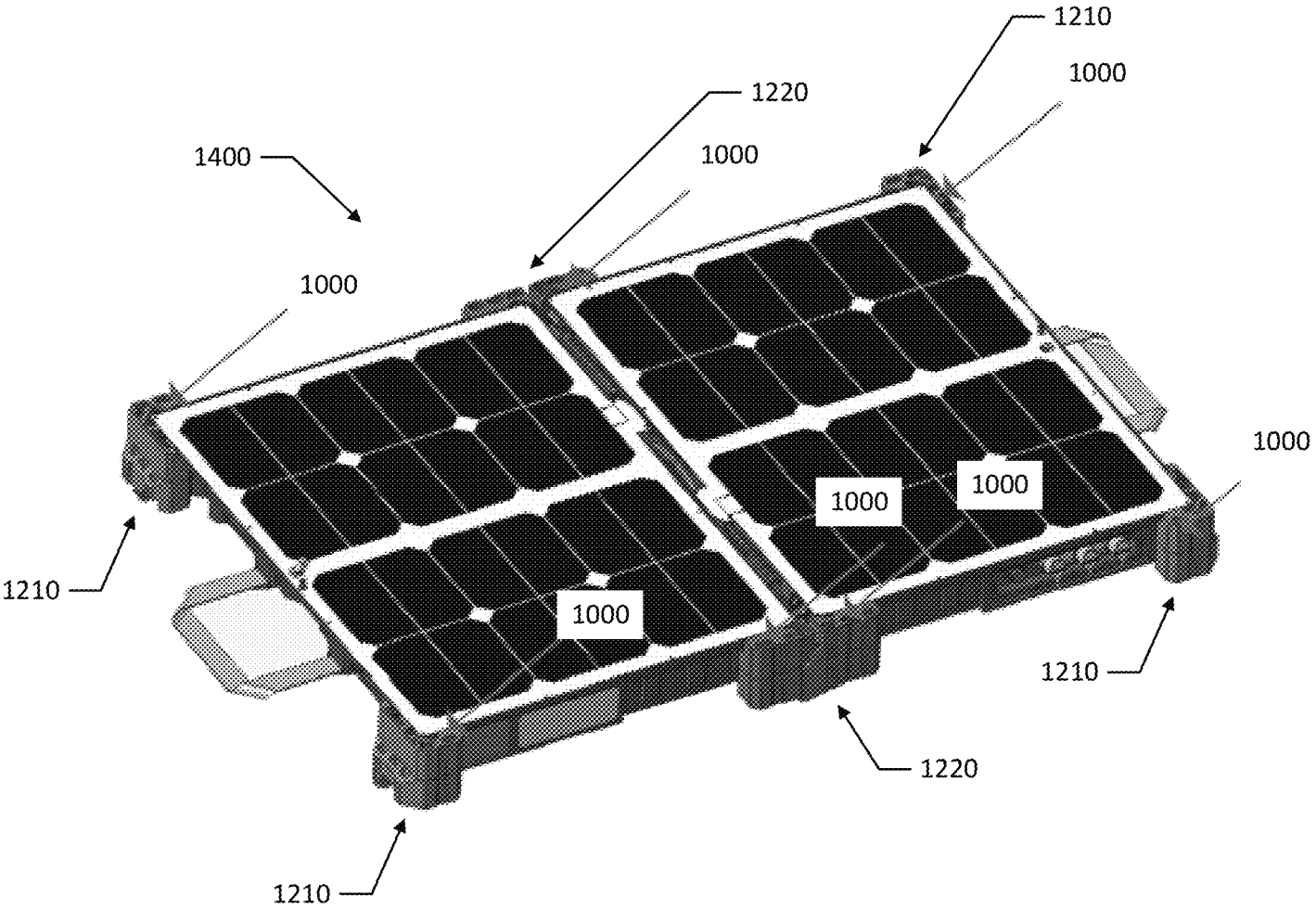
FIG. 13 shows an exemplary set of corner bumpers, according to at least one embodiment of the present disclosure, installed on an illustrative carryable case in an open position.
Figure 18:
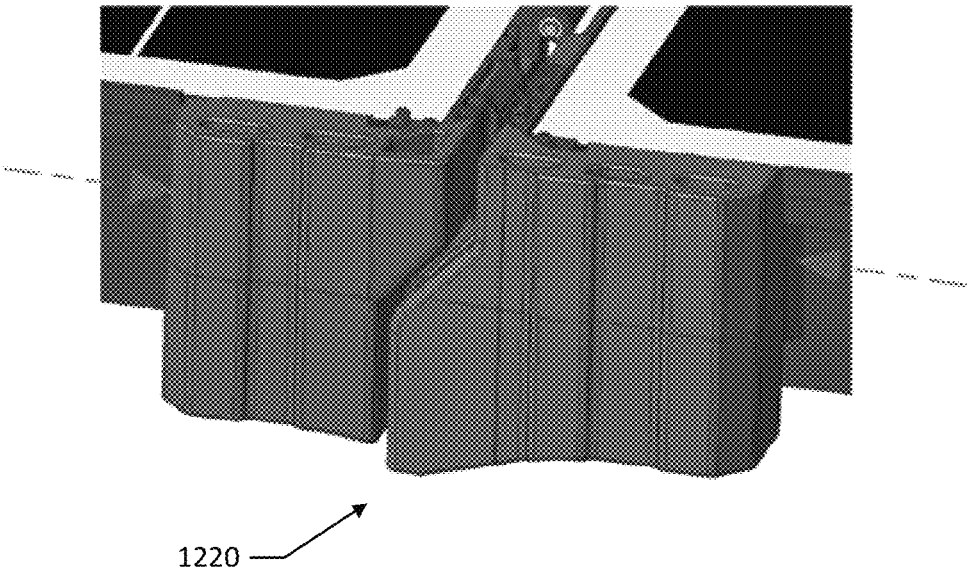
FIG. 18 is an elevated side perspective view of an exemplary set of corner bumpers, according to at least one embodiment of the present disclosure, installed on the base corners of an illustrative carryable case in a fully open position.

As shown in FIG. 3, when the carryable case 300 is in the closed position, the side walls of neighboring bumpers abut one another, forming, in effect, a continuous panel. Likewise, as shown in FIG. 12, when the carryable case 1300 is in the closed position, the side walls of neighboring bumpers abut one another, forming, in effect, a continuous panel. This arrangement allows lateral impact force to one bumper to be distributed to the opposing bumper and dissipated, thereby mitigating potential damage to the case or contents therein. A further advantage of the abutment of opposing bumpers is that a certain amount of elastic pressure is generated by the contacting surfaces of the bumpers that would tend to separate the halves of the case. When a mechanical latching mechanism is used to secure the two halves of the case in the closed position, this pressure serves to add extra tension to the latch, thereby keeping the halves firmly closed. As shown in FIG. 18, the corner bumpers may also contact each other in an open position, thus forming, in effect, a continuous panel for transferring impact.

Figure 9:
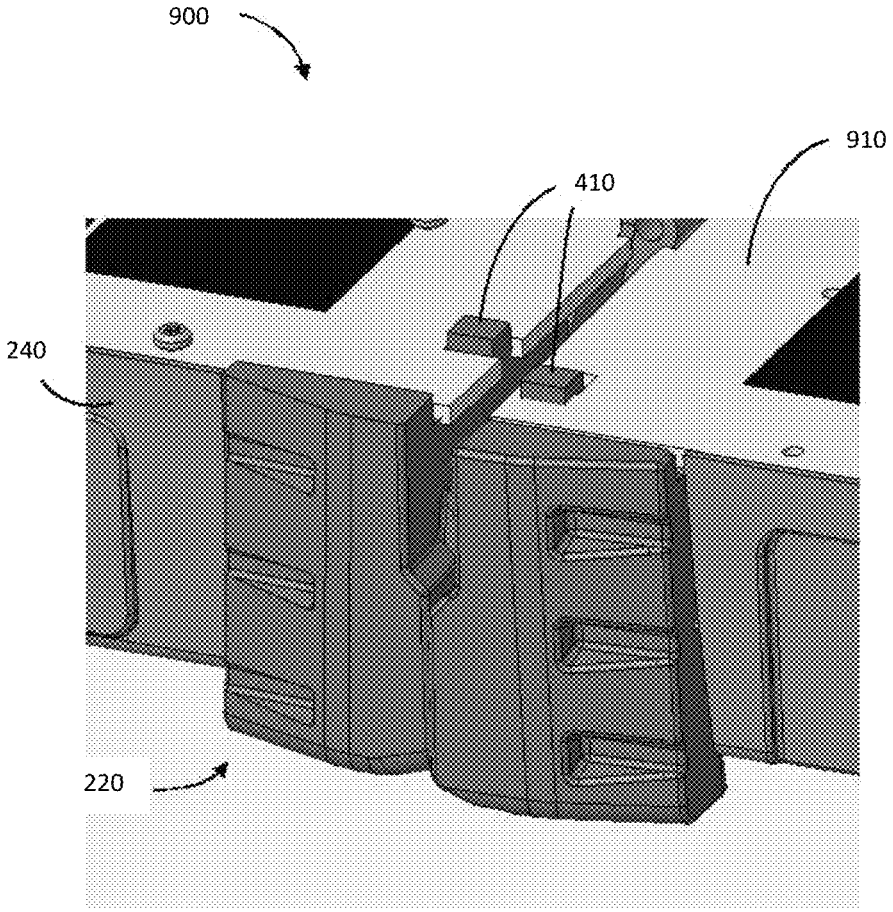
FIG. 9 is an elevated side perspective view of an exemplary set of corner bumpers, according to at least one embodiment of the present disclosure, installed on the base corners of an illustrative carryable case in a fully open position.
Figure 22:
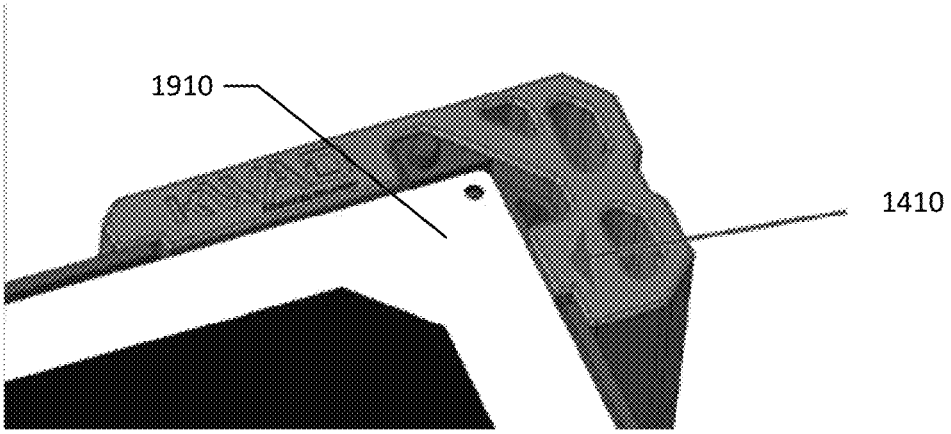
FIG. 22 shows an elevated top perspective view of a corner bumper installed a corner of an illustrative carryable case.

An additional feature of the exemplary bumper disclosed herein is one or more integral sidewall extensions 135 (see FIG. 1-B) coextensive with the bumper 100 that can further operate to dispel impact force, and also support and cushion fragile components in the case interior. In the example shown in FIGS. 4, 9, which illustrate a case 400 with extensions 410 in an open position, FIG. 4, and a case 900 with extensions 410 in an open position, the extensions 410 support and stabilize solar panels 910 mounted inside the case. Likewise, FIG. 22 shows a lateral feature 1110 of a corner bumper that acts to stabilize a solar panel 1910 inside the case.

From the foregoing description it will be appreciated that the various embodiments set forth herein, in accordance with the present inventive concept, provide a corner protector for a carryable case in the form of a shock-absorbing bumper which protects the case and any contents therein from damage due to collision with an external object. The bumper disclosed is particularly purposed to ruggedize a case enclosing relatively fragile or delicate articles, such as electronic, or other technical implements.

While various embodiments have been described above, it should be understood that they have been presented by way of example only, and not limitation. It will be apparent to persons skilled in the relevant art that various changes in form and detail can be made therein without departing from the spirit and scope of the embodiments. Thus, the breadth and scope of the embodiments should not be limited by any of the above-described exemplary embodiments, but should be defined only in accordance with the following claims and their equivalents.

What is claimed is:

1. A carryable case configured to house at least one electronic apparatus, said carryable case comprising:

a pair of side portions joined together at one respective end thereof, each side portion comprising four corners and being openable with respect to the other;

a corner bumper configured to be affixed to at least one of the corners of each side portion, the corner bumper comprising:

at least three adjacent, intersecting wall portions;

at least one wall portion having a denticulate foot component comprising a two-prong foot element that extends from the base of the case, thereby protecting the base from impact damage and providing a stable platform;

at least one wall portion that is configured to abut a neighboring bumper wall portion in order to transfer impact force to the neighboring bumper, whereby impact force is dissipated; and at least one wall portion having at least one integrated extension configured to stabilize components within the case housing, wherein the two-prong foot element is configured to mesh with a two-prong foot element of a neighboring bumper, whereby the case halves open to assume a common plane.

2. The carryable case of claim 1, wherein the corner bumper is configured to be mechanically affixed to the exterior of the side portion.

3. The carryable case of claim 2, wherein the corner bumper is configured to be affixed to the exterior of the side portion using one or more of screws, rivets, bolts, pins, adhesives, clips, snap-on elements, and combinations thereof.

4. The carryable case of claim 1, wherein the corner bumper further comprises a metallic securing plate that includes one or more mounting through-holes configured for receiving fastening articles.

5. The carryable case of claim 1, wherein the corner bumper is configured to be removably affixed to the side portion.

6. The carryable case of claim 1, wherein the corner bumper is configured to be integrally molded with the side portion.

7. The carryable case of claim 1, wherein the corner bumper further comprises one or more internal air-filled cavities.

8. The carryable case of claim 1, wherein the corner bumper is configured to mesh with a corner bumper of another carryable case in order to facilitate stable stacking in a horizontal stacking orientation.

9. The carryable case of claim 1, wherein the corner bumper is configured to mesh with a corner bumper of another carryable case in order to facilitate stable stacking in a vertical stacking orientation.

* * * * *